United States Patent [19]

Goto et al.

[11] 4,267,975

[45] May 19, 1981

[54] APPARATUS FOR WIRE EXPLOSION SPRAY COATING

[75] Inventors: Takeshi Goto, Akashi; Akio Tanaka, Ono; Yasuo Suzuki, Nagaokakyo, all of Japan

[73] Assignees: Kawasaki Jukogyo Kabushiki Kaisha, Kobe; Nissin Electric Co., Ltd., Kyoto, both of Japan

[21] Appl. No.: 21,704

[22] Filed: Mar. 19, 1979

[30] Foreign Application Priority Data

Mar. 20, 1978 [JP] Japan ..... 53-32236[U]

[51] Int. Cl.[3] ..... B05C 13/00

[52] U.S. Cl. ..... 239/83; 219/76.1; 228/2.5; 228/107; 118/302; 118/620; 118/688; 427/422; 427/427; 427/12

[58] Field of Search ..... 427/12, 422, 421, 473, 427/427, 445; 239/81, 83, 84; 228/2.5, 107; 219/112, 76.1; 156/275, 272, 280; 118/300, 620, 302, 688

[56] References Cited

U.S. PATENT DOCUMENTS 3,552,653 1/1971 Inoue ..... 239/81
4,008,117 2/1977 Dybwad ..... 118/620 X

FOREIGN PATENT DOCUMENTS 3946101 12/1968 Japan ..... 427/422
4311794 5/1970 Japan ..... 427/422
4411592 4/1974 Japan ..... 427/422
4183689 8/1974 Japan ..... 427/422

*Primary Examiner*—Shrive P. Beck
*Attorney, Agent, or Firm*—Fleit & Jacobson

[57] ABSTRACT

Apparatus for a wire spray coating method including a capacitor connected with an electric power source to be charged thereby. A gap switch having discharge electrodes which are spaced apart from each other so that a discharge is produced under a voltage applied by the capacitor. Wire receiving terminals which are spaced apart to receive a length of wire of coating material therebetween, the terminals being connected with the capacitor so that the charge of the capacitor is applied to the terminals through the switch. The discharge electrodes being maintained at a fixed distance so that a discharge across the electrodes is readily produced when the electrodes are supplied with the voltage from the capacitor. A voltage dividing element for applying a fraction of the voltage across the capacitor to the discharge electrodes and the remainder of the voltage to the wire receiving terminals when the wire is not in position between the terminals, but for applying substantially a total voltage of the capacitor when the wire is in a position between the terminals.

3 Claims, 3 Drawing Figures

APPARATUS FOR WIRE EXPLOSION SPRAY COATING

Figure 1:
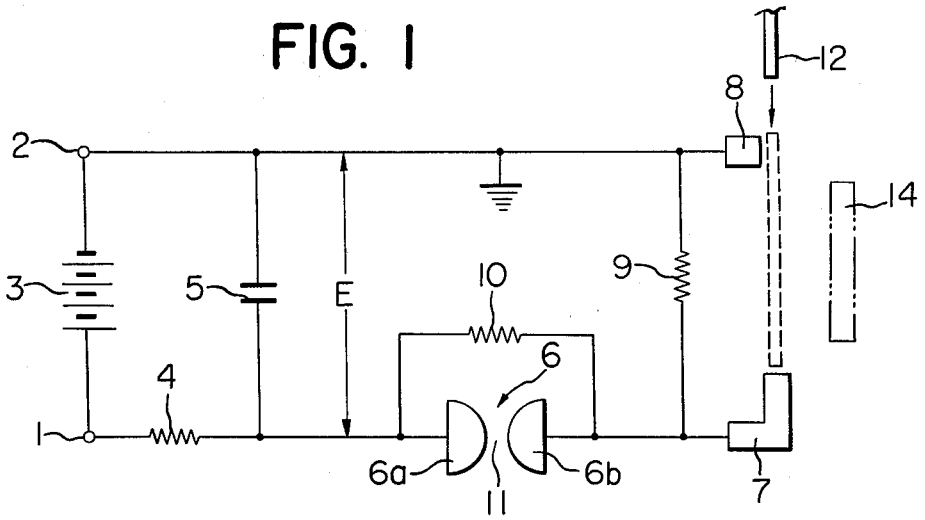

The present invention relates to a process and apparatus for wire explosion spray coating wherein a wire of a coating material is explosively molten under a high electric energy discharged from a capacitor so that the molten material is driven at a high speed to a workpiece.

Japanese patent publication Sho 43-27922 discloses a process wherein a wire of a coating material is connected in a discharge circuit having an energy storage capacitor and a trigger switch which are connected in series. An electric power source is connected in parallel with the capacitor so that the latter is charged with an electric energy while the trigger switch is opened. In order to effect the wire explosion process, the trigger switch is closed so that the energy stored in the capacitor is discharged to produce a high intense current through the wire. Japanese patent publication Sho 49-30336 discloses a circuit wherein a discharge gap switch is used in place of the trigger switch.

A typical example of such a discharge gap type trigger switch is shown and described in Japanese utility model publication Sho 45-10505. The switch has a pair of opposing discharge electrodes, one being stationary and the other movable toward and away from the first mentioned electrode. An air cylinder is provided for driving the movable electrode. Where this type of trigger switch is used in the wire explosion spray coating circuit, the movable electrode is at first located apart from the stationary electrode so that an adequate air gap is provided therebetween for preventing discharge, and a wire of the coating material is then connected between a pair of terminals provided for the purpose. Thereafter, the air cylinder is actuated to drive the movable electrode toward the stationary electrode until the distance between the electrodes is decreased to such an extent that a discharge is produced through the air gap between the electrodes. In this type of trigger switch, problems have been encountered in that the movable electrode must be reciprocated at a high speed under the action of the air cylinder so that it has been frequently required to effect adjustments and replacements of movable parts.

Another known type of trigger switch has a pair of discharge electrodes which are spaced apart to provide a discharge gap therebetween. A third or trigger electrode is positioned between the discharge electrodes and supplied with a trigger voltage to initiate the discharge between the discharge electrodes. This type of trigger switch is disadvantageous in that the trigger electrode is rapidly worn and that metal particles produced as the result of the wear of the trigger electrode are deposited on insulator surfaces possibly causing creep discharge along such surfaces. Further, an expensive control circuit is required for providing the trigger voltage to the trigger electrode.

It should further be noted that the known process for wire explosion spray coating has been generally disadvantageous in that time is required in connecting the wire to the circuit terminals and that the terminals are rapidly worn and get rusty. It has therefore been very often required to perform inspection and replacement of the terminals, such works being not only dangerous but ineconomical because the processes must be interrupted.

In order to provide an improved manner of supplying a wire between the paired terminals, it has been proposed by Japanese patent publication Sho 49-16706 to use a roll of a continuous wire and feed it intermittently between the terminals. However, the proposed process is impractical because electric current may be produced throughout the length of the wire and the wire feed rollers so that the wire feed mechanism must be adequately from the remaining parts of the apparatus. It is therefore advisable to supply the wire in a form cut to a required length, however, even if the supply of wire is made in this way, a substantial interval is required between each two explosion steps as long as the aforedescribed gap switch is used.

It may therefore be considered advisable to omit the trigger switch in the discharge circuit and design the circuit in such a way that the discharge from the capacitor is initiated as soon as the wire is supplied in position. The process is however disadvantageous in that the charge voltage of the capacitor is totally applied between the wire receiving terminals throughout the process. Since insulators supporting the terminals may be contaminated by deposits of metals which are produced as the result of wire explosion, the charge of the capacitor may be allowed to leak through such metal deposits. Another problem inherent to this process is that a leader stroke may be produced between the leading end of the wire and the cooperating terminal before the wire completely bridges the terminals. When such leader stroke is produced, there will be an appreciable energy loss due to a discharge arc resistance.

It is therefore an object of the present invention to provide a wire explosion spray coating process in which the aforementioned problems of prior art can be eliminated.

Another object of the present invention is to provide a wire explosion spray coating process in which time interval between each two succeeding steps can be substantially decreased.

A further object of the present invention is to provide a wire explosion spray coating process which can use simple and reliable discharge gap switch.

According to the present invention, the above and other objects can be accomplished by a process using a circuit which includes capacitor means connected with electric power source means to be charged thereby, gap switch means having discharge electrodes which are spaced apart each other so that a discharge is produced under a voltage applied by the capacitor means and wire receiving terminals which are spaced apart to receive a length of wire of coating material therebetween, said terminals being connected with the capacitor means so that charge of the capacitor means is applied to the terminals through the switch means, said process being characterized by the fact that the discharge electrodes are maintained throughout the process at a fixed distance wherein a discharge across the electrodes is readily produced when the electrodes are applied with the voltage from the capacitor means and a wire is supplied between the terminals so as to bridge them through discharge between the wire and the terminals whereby a high density current is produced through the wire.

Resistor means may be connected between the discharge electrodes and also between the terminals to provide a voltage divider. The resistor means may of course be substituted by capacitor means.

Figure 2:
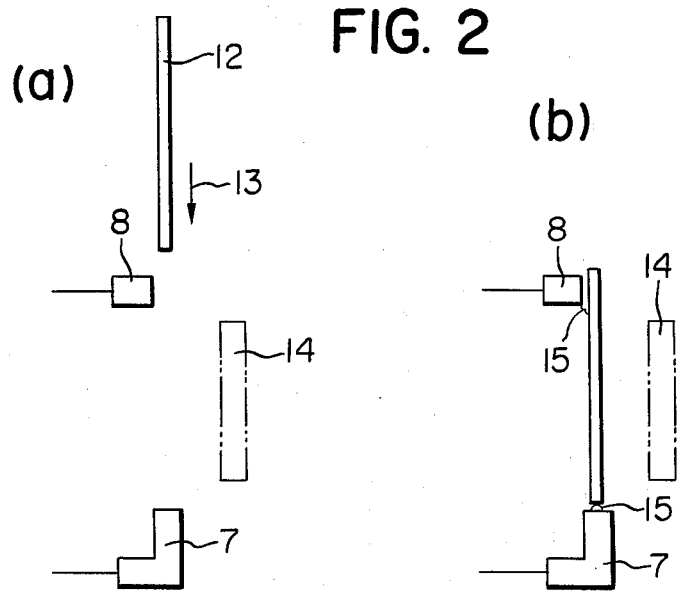
Figure 3:
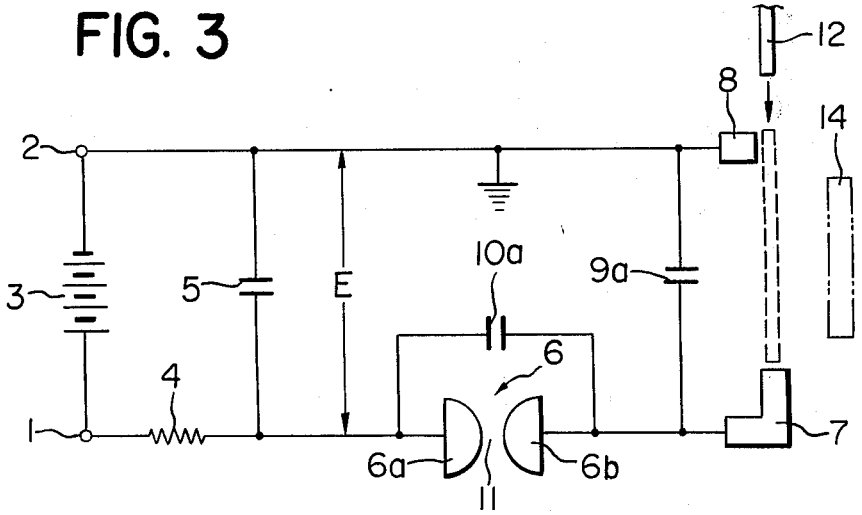

The above and other objects and features of the present invention will become apparent from the following descriptions of preferred embodiments taking reference to the accompanying drawings, in which:

FIG. 1 is a circuit diagram showing an example of the wire explosion spray coating apparatus which can be used in the process in accordance with the present invention;

FIG. 2 (a) and (b) show the manner of supplying a wire of coating material; and, FIG. 3 is a circuit diagram similar to FIG. 1 but showing another example.

Referring now to the drawings, particularly to FIG. 1, the circuit shown therein has power input terminals 1 and 2 which are connected with an electric power source 3. The terminal 1 is connected through a resistor 4 with an energy storage capacitor 5 which is in turn connected with the terminal 2. The capacitor 5 is on one hand connected through a switch 6 with a wire receiving terminal 7 and on the other hand with a second wire receiving terminal 8 which is grounded in this embodiment. Between the terminals 7 and 8, there is connected a resistor 9. The switch 6 is comprised of a pair of discharge electrodes **6*a* and 6*b* and a resistor 10 bridging the electrodes 6*a* and 6*b*. The resistors 9 and 10 together constitute a voltage divider. The discharge electrodes 6*a* and 6*b* are spaced to provide a discharge gap 11 which is so determined that a discharge can readily be produced when the voltage across the capacitor 5 is applied across the electrodes 6*a* and 6*b***.

As shown in FIG. 2, a wire 12 of coating material is fed in the direction shown by an arrow 13 to the position substantially bridging the terminals 7 and 8. In FIG. 1, it will be noted that, when the capacitor 5 is charged with a voltage E, the voltage across the discharge electrodes **6*a* and 6*b* is $ER_{10}/R_{10}+R_9$ while the voltage across the terminals 7 and 8 is $ER_9/R_9+R_{10}$, where $R_9$ and $R_{10}$ are resistance values of the resistors 9 and 10, respectively. A workpiece 14 is positioned aside the wire 12 which is between the terminals 7 and 8**.

In operation, the capacitor 5 is at first charged to a voltage E and the wire 12 is fed between the terminals 7 and 8 as shown in FIG. 2. As the wire 12 is proceeded to a position sufficiently close to the terminals 7 and 8, discharge arcs 15 are produced between the terminals 7 and 8 and the wire 12. Thus, the terminals 7 and 8 are bridges by the wire 12 and the discharge arcs 15. The discharge arc current is in this instance approximately $E/R_{10}$ which is in the order of a few milliamperes so that the wire is not molten under the discharge current. As soon as the terminals 7 and 8 are thus bridged, the voltage across the discharge electrodes **6*a* and 6*b* is increased to a value substantially equal to the voltage across the capacitor 5 whereby a discharge is produced across the electrodes 6*a* and 6*b*. Thus, the charge in the capacitor 5 is instantaneously applied to the wire 12 to produce a current sufficient to have the wire explosively molten and driven toward the workpiece 14**.

For example, where the charge voltage of the capacitor 5 is 20 KV and the resistance values of the resistors 9 and 10 are both 10 MΩ, the voltage across the discharge electrodes **6*a* and 6*b* and that across the terminals 7 and 8 are both 10 KV. When the wire 12 is placed between the terminals 7 and 8 to bridge them, the voltage across the discharge electrodes 6*a* and 6*b*** *a* is increased to approximately 20 KV. The resistance values of the resistors 9 and 10 can be determined as desired but they should be as large as possible in order to decrease the current therethrough.

Referring to FIG. 3 which shows another example of the discharge circuit, the resistors 9 and 10 in the previous example are substituted by capacitors **9*a* and 10*a***, respectively. In other respects, the circuit is the same as that in the previous example so that corresponding parts are designated by the same reference numerals as in the previous example.

According to the present invention, the time interval between each two succeeding steps can be significantly decreased since it is no longer necessary to hold the wire and to detect that the wire receiving terminals are bridged by the wire before the gap switch is triggered. Since it is not required to hold the wire by the wire receiving terminals, time required for maintenance of the terminals can be decreased. The discharge electrodes are fixed in position and are not associated with any triggering mechanism. Therefore, the switch can be of less expensive and reliable structure. There is no means for supporting the wire during the explosion process so that specific consideration is not required for insulation. The voltage across the wire receiving terminals is maintained at a low level except the instance of explosion so that it is possible to avoid any current leak or insulation failure even in an atmosphere containing metal particles. Further, it is possible to efficiently utilize the energy charged in the capacitor since the energy is instantaneously discharged for explosion.

The invention has thus been shown and described with reference to specific embodiments, however, it should be noted that the invention is in no way limited to the details of the illustrated arrangements but changes and modifications may be made without departing from the scope of the appended claims.

We claim:

1. Apparatus for wire spray coating including capacitor means connected with electric power source means to be charged thereby, gap switch means having discharge electrodes which are spaced apart from each other so that a discharge is produced under a voltage applied by the capacitor means, and wire receiving terminals which are spaced apart to receive a length of wire of coating material therebetween, said terminals being connected with the capacitor means so that charge of the capacitor means is applied to the terminals through the switch means, said discharge electrodes being maintained at a fixed distance, wherein a discharge across the electrodes is readily produced when the electrodes are supplied with the voltage from the capacitor means, voltage dividing means for applying a fraction of the voltage across the capacitor means to the discharge electrodes and a remainder of the voltage to the wire receiving terminals when the wire is not in position between the terminals, but for applying substantially a total voltage of the capacitor means when the wire is in position between the terminals.

2. Apparatus in accordance with claim 1 in which said voltage dividing means is comprised of first resistor means connected across the discharge electrodes and second resistor means connected across said terminals.

3. Apparatus in accordance with claim 1 in which said voltage dividing means is comprised of first capacitor means connected in parallel with the discharge electrodes and second capacitor means connected in parallel with the terminals.

* * * * *